United States Patent [19]

Hines et al.

[11] Patent Number: 4,790,697

[45] Date of Patent: Dec. 13, 1988

[54] AUTOMATIC GRINDER

[75] Inventors: Gordon E. Hines, Ann Arbor; Lee D. Case, Monroe; Ronald W. Anderson, Ann Arbor, all of Mich.

[73] Assignee: Hines Industries, Inc., Ann Arbor, Mich.

[21] Appl. No.: 52,835

[22] Filed: May 21, 1987

[51] Int. Cl.[4] ..... B23C 3/00; G01M 1/38

[52] U.S. Cl. ..... 409/133; 51/169; 73/462; 408/2

[58] Field of Search ..... 408/2, 11, 16; 409/133, 409/131, 132, 195; 73/468, 462, 460; 51/169

[56] References Cited

U.S. PATENT DOCUMENTS

| | | | |
|---|---|---|---|
| 3,854,339 | 12/1974 | Müller | 73/462 |
| 3,934,963 | 1/1976 | Langlois | 408/2 |
| 4,104,919 | 8/1978 | Brunnengräber | 408/13 |
| 4,214,481 | 7/1980 | Reutlinger | 74/462 |
| 4,442,712 | 4/1984 | Junck | 409/133 |
| 4,506,133 | 4/1984 | Inoue | 73/468 |
| 4,545,021 | 10/1985 | Suzuki et al. | 73/460 |

FOREIGN PATENT DOCUMENTS

| | | | |
|---|---|---|---|
| 48178 | 3/1982 | European Pat. Off. | 73/460 |
| 132641 | 8/1983 | Japan | 73/460 |
| 114735 | 6/1985 | Japan | 73/460 |
| 599173 | 3/1978 | U.S.S.R. | 408/2 |

*Primary Examiner*—William R. Briggs

*Attorney, Agent, or Firm*—Emch, Schaffer, Schaub & Porcello Co.

[57] ABSTRACT

A method and apparatus for the automatic balancing of workpiece having diverse surface geometry is disclosed. The balancing machine of the present invention provides for computer numerical controls in the balancing and material removal operations. The processes provide for alternative methods of material removal and further provides for the balancing operation to be self-calibrating and self-programming.

24 Claims, 7 Drawing Sheets

AUTOMATIC GRINDER

BACKGROUND OF THE INVENTION

The present invention relates to an automatic balancing machine which incorporates computer numerical control correction methods. The balancing machine of the present invention is completely automatic.

Balancing machines of past design have incorporated the use of milling or drilling operations for material removal. If the workpiece being balanced was geometrically conductive, the amount of material removed required was known before the material removal process started. However, with geometrically complex shapes, the balancing operation required that the workpiece be placed on the balancer and the amount of correction needed be determined and the angle of correction was marked. If the workpiece geometry required grinding as the material removal method, the operator would manually grind the workpiece. The workpiece would again be measured and the routine repeated until tolerance was reached. Applicant's invention provides an computer control and data analysis system which overcomes the disadvantages of incorporating grinding material removal and enhances the ability to use grinding material removal methods as well as the more common milling and drilling methods in balancing complex geometric workpieces.

Applicant's invention envisions the use of a grinding mechanism for material removal over the more common methods of drilling and milling. However, it is to be understood that milling and drilling operations can be incorporated with or distinct from the grinding operation depending upon the individual needs of the machine design. Applicant's preference for grinding as a method of material removal lies in the reasons that grinding provides a desirable amount of surface finish control with an uninterrupted or smooth transition surface which is less likely to create noise or gather debris. Grinding also provides a method of material removal which spreads the correction over a wider area so that material can be removed at a faster rate. The wide variety of grinding mechanisms available also serves to enhance the balancing of complex and fragile surfaces.

The present invention also improves upon current state-of-the-art through the use of a computer numerical controller to calculate material removal and workpiece/tool positioning. While the computer numerical control system makes grinding feasible in a balancing operation, it also enhances the quality of drilling and milling processes. To this point in time, currently available driling and milling processes depend solely upon geometric correction methods. That is, if the diameter of the tool and the length of the cut are known, the material removed can be calculated. However, with complex geometric shapes, the geometric calculations are complex and difficult. The computer numerical control system of the present invention seeks to solve these shortcomings through internal calculations concerning percent correction, averaging, and information feedback as well as stored information relating to workpiece profile and workpiece history.

SUMMARY OF THE INVENTION

The present invention provides an automatic balancing machine for use in balancing parts and workpieces having diverse surfaces which need finely tuned balancing, such as turbines and their components, impellers and the like. The balancing machine incorporates computer numerical control calculations of correction factors and a preferred embodiment of this invention utilizes selected methods of grinding for material removal during balancing corrections. Other embodiments of the present invention may incorporate a method of grinding with other devices of material removal such as milling or drilling. Finally, the computer numerical controls of the present invention are applicable for use with milling and/or drilling solely. The information profiling and feed back features of computer numerical control enable the operator to greatly expand the use of these correction methods.

The present invention combines the application of computer numerical control correction calculations with various material removal methodologies to enable it to finely balance workpieces having irregular surfaces and varying geometric shapes as well as well-defined shapes and various combinations of surfaces. The balancing machine of the present invention is designed for selected use with a variety of material removal devices such as grinding belts, disks, rotary files, rasps and reciprocating files and wheels to provide part corrections in varying applications. The present invention can also be adapted for use with many milling and drilling material removal methodologies.

The computer controlled methodology is utilized in the present invention to calculate material removal rate profiles and update information within the balancing machine system without outside operator action. The micro computer used with the present invention provides calculations for the unbalance measurement which are self-calibrating, self-compensating, able to calculate machining parameters for unusual material removal methods, and also for control of the machining operation. The micro computer is capable of designing its own workpiece correction profile as a result of data collected from previous operation and calculation. The present invention further provides the ability to facilitate adjustment of force/time, unit/time, time only of various other combinations of these variables in reference to material removal. As a result, the present invention is designed to provide an automatic balancing operation which is versatile and extremely adaptable to the small tolerance balancing needs of critical workpieces and parts.

DETAILED DESCRIPTION OF THE DRAWINGS

Figure 1:
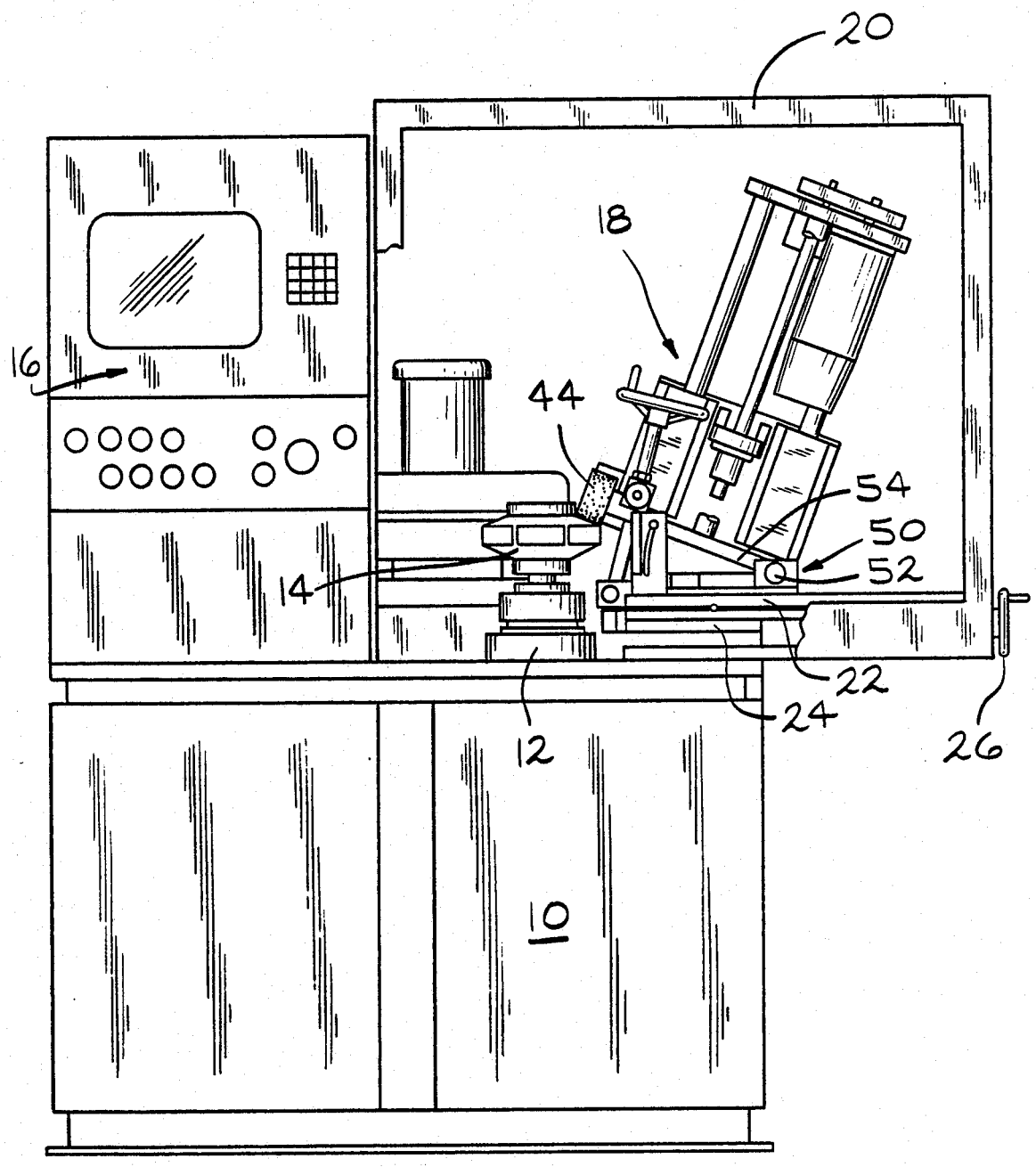
FIG. 1 shows a front view of an automatic balancing machine of the present invention.

The balancing machine of the present invention has a base member 10 upon which a support stand 12 and mount 14 for the workpiece is positioned. The workpiece mount 14 is in communication with a drive member (not shown) for rotation. Motion sensors (not shown) are in communication with the support stand 12 which measure the vibration of the support stand 12 during rotation of the workpiece to determine the unbalance of the workpiece. A controller 16 consisting a micro computer is in communication with the motion sensor and the drive member. The controller 16 provides the calculations for the unbalance measurement and angle and also provides the necessary operating controls for the material removal operation.

The material removal device 18 is supported by the base member 10 adjacent the support stand 12 and workpiece mount 14. In a preferred embodiment of the invention, the support stand 12, workpiece mount 14 and material removal device 18 are enclosed within a dust shroud 20. In most applications, a vacuum (not shown) is located proximate the material removal device 18 to draw unwanted material particles from the machine environment.

The balancing machine of the present invention is intended to provide for small tolerance automatic balancing from the point of loading the part onto the workpiece mount 14. However, the machine is designed to adapt to a transfer system (not shown) wherein the workpiece parts are automatically positioned on the mounting member and removed from the mounting member after balancing.

Referring now to FIGS. 1, 2, 3 and 4, one embodiment of the material removal device 18 of the present invention will be described. The material removal device 18 is mounted on the base member 10 by a base slide 22. The material removal device 18 moves on the base slide 22 and is driven by a drive screw 24 which can be servo driven (not shown) or manually cranked 26. The material removal apparatus consists of a primary mounting plate 28 positioned on a slide mechanism 34. A drive screw 30 operated by a positioning drive 32 is fixed to the primary mounting plate 28 to drive the primary mounting plate 28 along the slide mechanism 34. An encoder keeps track of the direction and distance traveled by the mounting plate on the slide mechanism 34.

Figure 2:
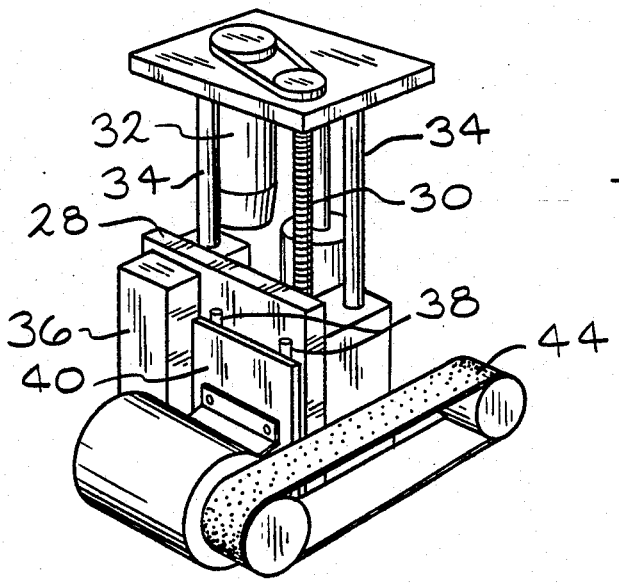
FIG. 2 shows a perspective view of one embodiment of the material removal head of the balancing machine of FIG. 1.
Figure 3:
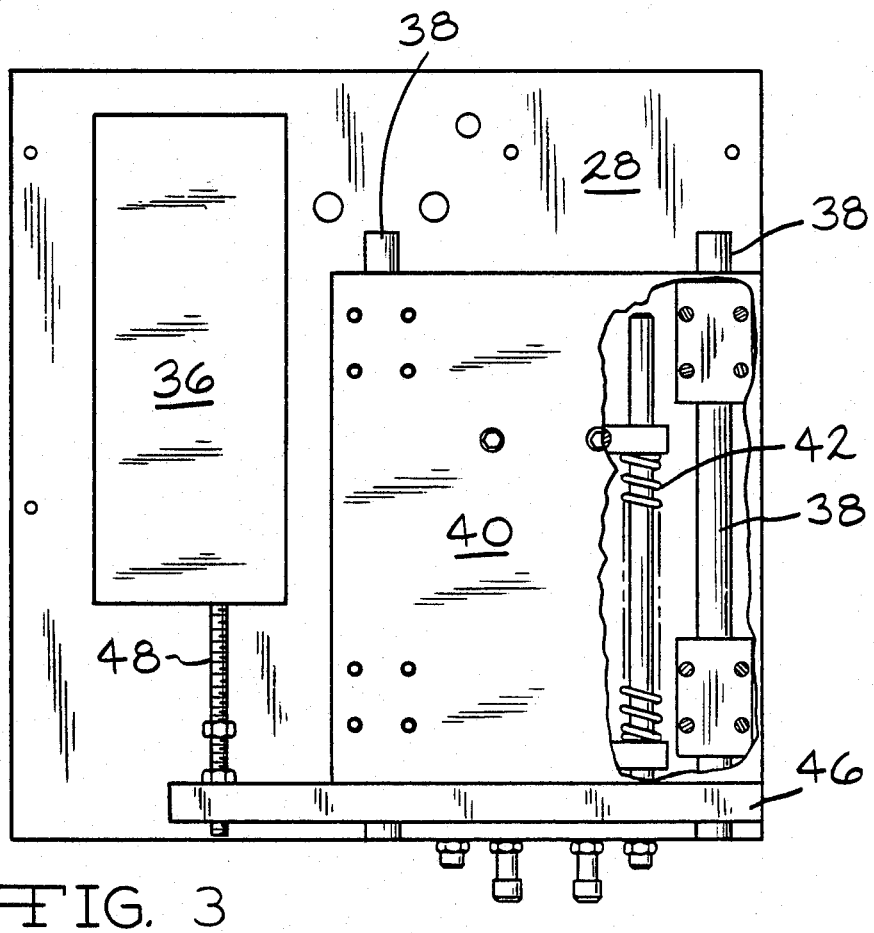
FIG. 3 shows a cut away view of the mounting plate for the material removal head of FIG. 2.

Referring specifically to FIGS. 2 and 3, to the primary mounting plate 28 is attached a second slide mechanism 38. A second mounting plate 40 is positioned on the second slide mechanism 38 for movement. A set of springs 42, resistant in opposed directions is attached between the primary mounting plate 28 and the second mounting plate 40 to keep the second mounting plate 40 in referenced position with respect to the primary mounting plate 28. A material removal head 44, in this instance a belt grinder, is fixed to the second mounting plate 40. A lineal encoder 36 is positioned on the primary mounting plate 28. An actuator bar 46 is fixed to the second mounting plate 40 and is in communication with the lineal encoder 36 through an adjustable set member 48.

The material removal device 18 is mounted in an angular vertical position so that the material removal head 44 can move along the slide mechanism 34 to be removed from contact with the workpiece or to be placed into contact with the workpiece. In this embodiment of the present invention, the material removal head 44 moves into contact with the workpiece and the weight of the head 44 applies the grinding force during operation. Other embodiments will require a force to be applied by the drive screw 30, positioning drive 32 and slide mechanism 34 to move the material removal head 44 into contact with the workpiece.

Figure 5:
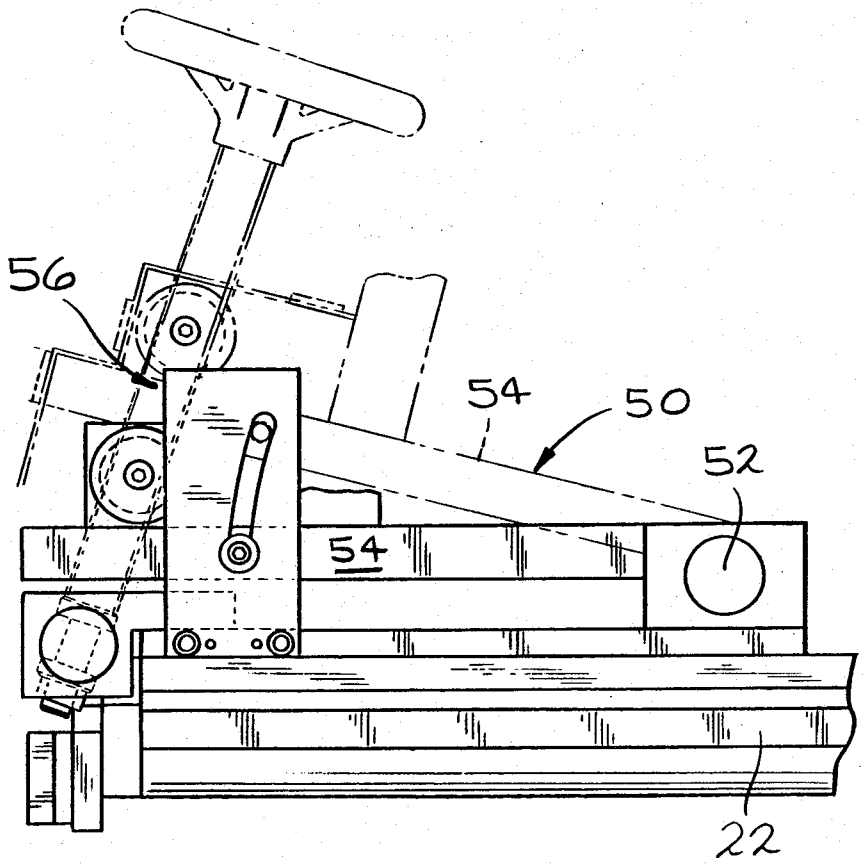
FIG. 5 shows a side view of the angle actuator of FIG. 4.
Figure 4:
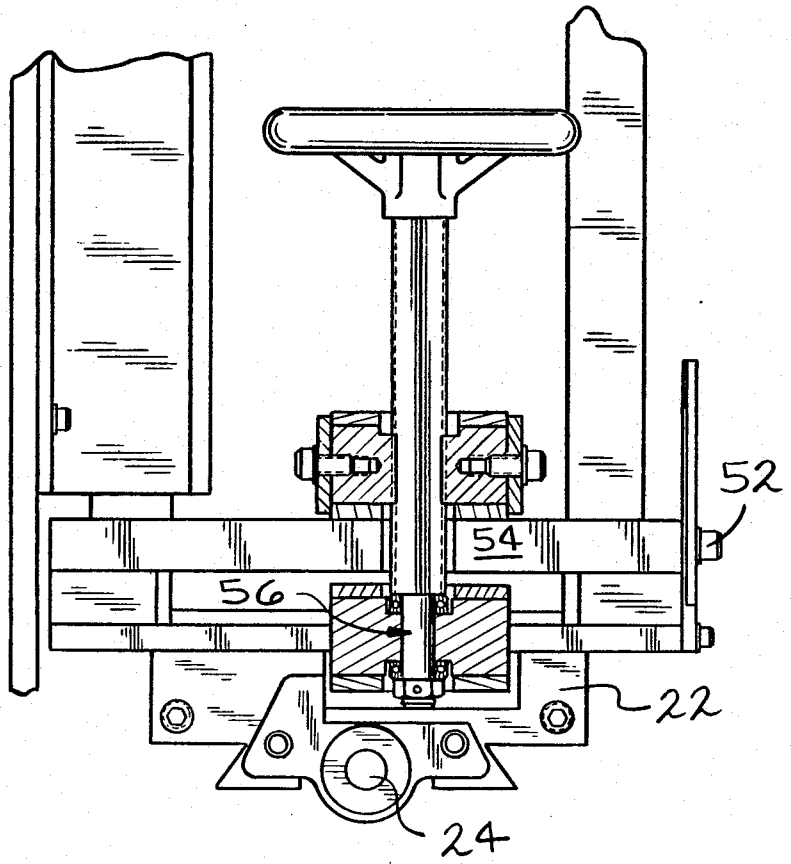
FIG. 4 shows a front view of the angle actuator for the material removal head of FIG. 2.

Referring now to FIGS. 4 and 5, the material removal device 18 is mounted on the base slide 22 by means of an angle actuator 50. The angle actuator 50 has a support plate 54 on which the material removal device 18 is fixed. The support plate is hinged 52 on one end and connected with an adjustable slide/lock combination 56 on the other end. The adjustable slide lock combinations 56 is used to vary the angle of the material removal device 18.

The linear encoder 36, mounted on the primary mounting plate 28 has the set member 48 of the encoder in contact with the actuator bar 46 which is fixed to the second mounting plate 40. The encoder measures the movement of the material removal head 44 in relationship to the location of the primary mounting plate 28. As the material removal head 44 is moved into contact with the workpiece, a zero reference point from which corrections can be calculated and made is established. Once the material removal head 44 is in contact with the workpiece and the zero reference point is calculated, the machine is mechanically set up to automatically balance a particular part.

The balancing machine of the present invention can be used to balance a differing variety of parts. Information on a particular part or number of different parts is stored or programmed into the computer controller 16 by the operator. The information on the particular part can be initially fed into the controller 16 or a reference number can be called up which updates already stored information on a particular part. The controller 16 internally sets up force/time relationships or time only relationships when the force is preset for the material removal correction sequences for any specific part which is programmed or stored in its memory.

Once the mechanical and programming set-ups have been entered, the balancing machine of the present invention is ready for operation. With the workpiece positioned directly under the material removal device 18 the positioning drive 32 operates to move the material removal head 44 into position. The weight of the material removal head 44 applies a force on the workpiece and the material removal head 44 is operated by the controller 16 for a given time to remove a specific amount of material. The material removal head 44 is then retracted to clear the workpiece. The workpiece is spun to determine what correction was made and if an additional correction is required. If an additional correction is required, the controller 16 calculates a new unit/time, force/time, time only, speed/time, or area/time correction factor and/or any combination of these and the material removal head 44 performs a second correction operation. This sequence continues until the part is corrected within preset tolerances or the part is rejected.

During operation, the positioning drive 32 lowers the primary mounting plate 28 on which the material removal head 44 is positioned until the material removal head 44 touches the surface of the workpiece. The contact with the workpiece is determined by detection of the motion of the actuator bar 46 by the lineal encoder 36 which senses the differential motion between the primary mounting plate 28 and the second mounting plate 40. That is, when the workpiece begins to take some of the weight off of the material removal head 44, the load on the springs 42 is lessened and the encoder 36 detects the relative motion. At this point, the controller 16 directs the positioning drive 32 to feed a known amount of force beyond part contact onto the workpiece by the material removal head 44.

In one preferred embodiment, the controller 16 calculates some initial values for material removal rates based upon dimensional parameters entered by the operator for the specified part. These initial values are determined by reference to a precalculated workpiece model and removal configuration and the refining of the model by part testing during the mechanical development of the machinery. A first try grind time is calculated by the controller 16 on this basis. In one embodiment, the time is calculated to make a preselected percentage of the total amount of needed unbalance correction. After correction, the unbalance is measured and the change in unbalance and the first grind time are used to re-calculate the actual removal rate and this number is used for the next correction.

The programming has several adjustments that can be made to optimize the correction rate. First, the initial guess for the removal rate may be adjusted. Secondly, the percent correction factor may be reset. Thirdly, the measured removal rate can be averaged with the previous removal rates. For instance, the rate to be used in the next calculation may be calculated to be the previous removal rate plus 30% of the difference between the previous and present measured removal rates. All of these factors can be adjusted experimentally until the best success rate for the unbalance correction is achieved.

Referring to FIG. 1, this particular embodiment of the present invention is utilized to correct workpieces of many sizes and shapes. The surface on which the correction is made is in some cases a horizontal plane and in other cases tilted to a conical shape about 20% with respect to horizontal. The material removal device 18 is mounted on the angle actuator 50 of FIGS. 4 and 5 so that it can be tilted to correspond with the workpiece surface angle and moved radially with respect to the workpiece to control the distance from the workpiece axis at which the correction would be made.

Figure 6:
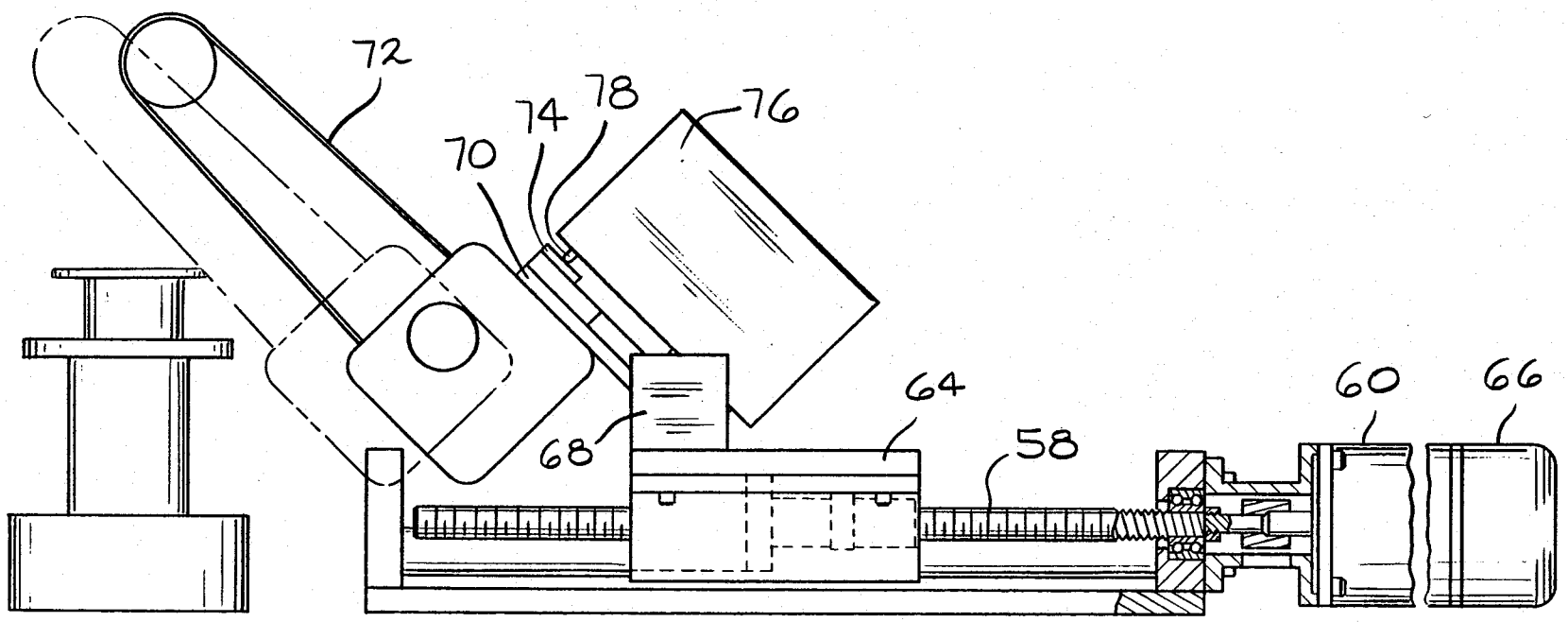
FIG. 6 shows a side view of an alternative embodiment of the material removal head of the present invention.
Figure 7:
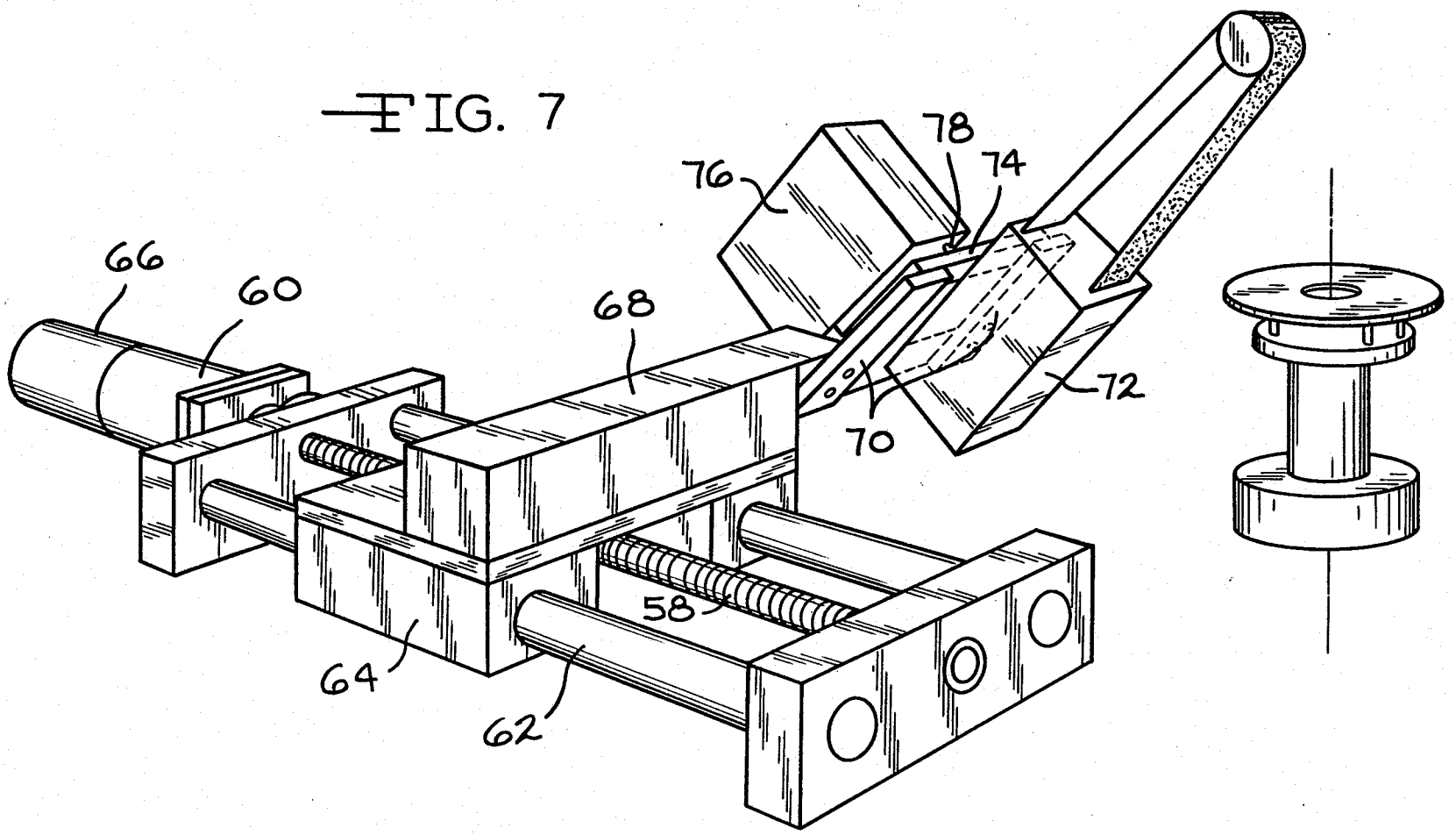
FIG. 7 shows a perspective view of the material removal head of FIG. 6.
Figure 8:
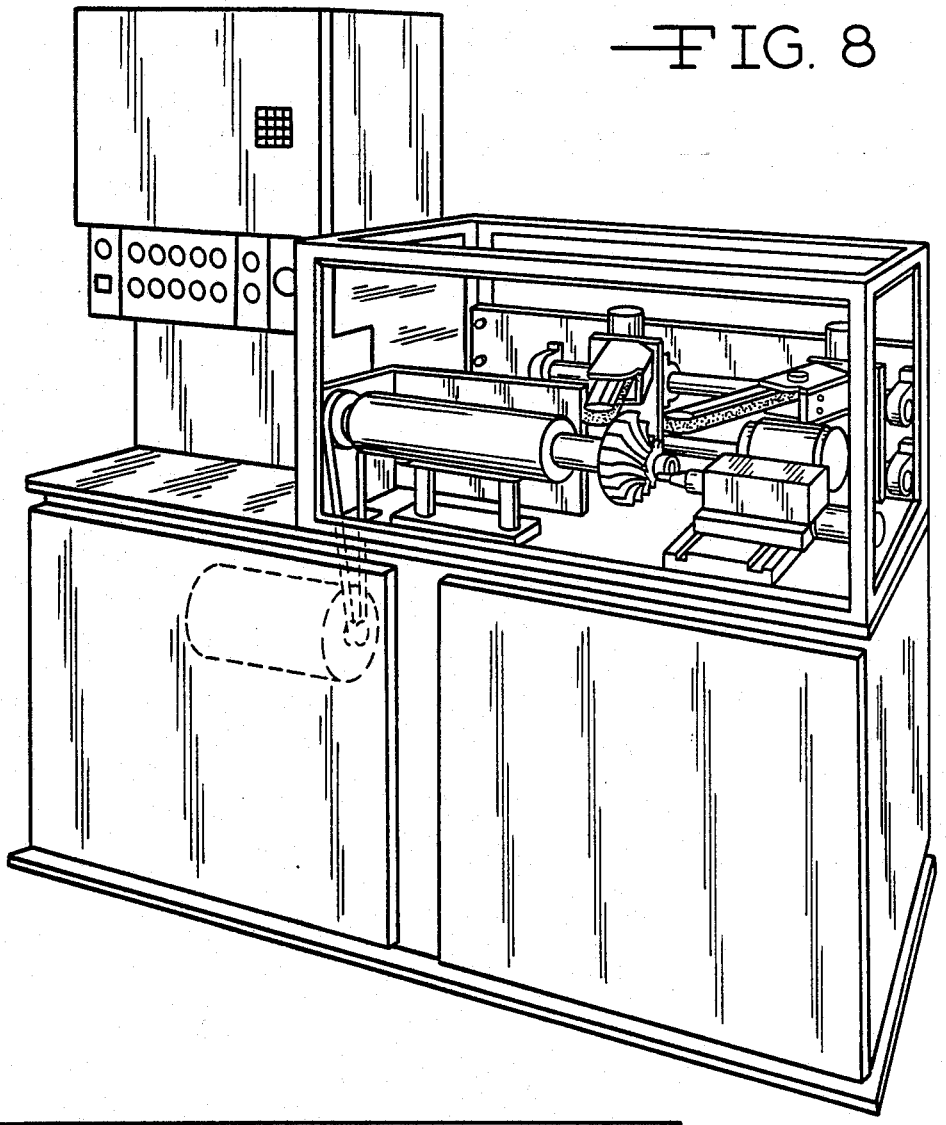
FIG. 8 shows a perspective view of an alternative embodiment of the present invention having a dual grinder and a milling device material removal head.
Figure 9:
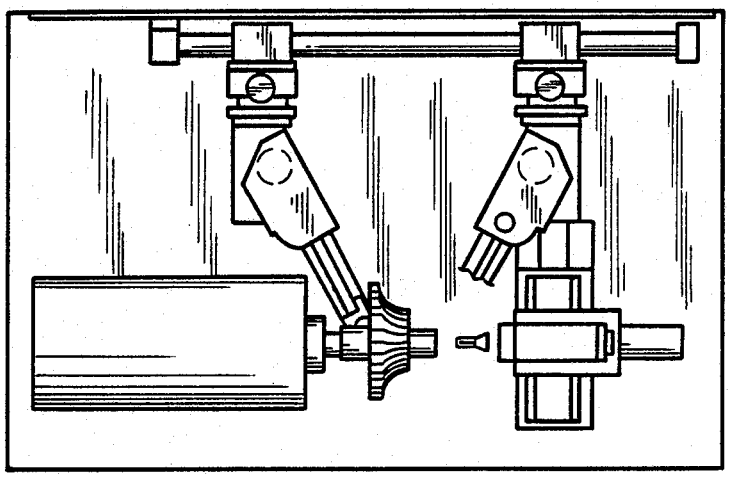
FIG. 9 shows a top view of FIG. 8.
Figure 10:
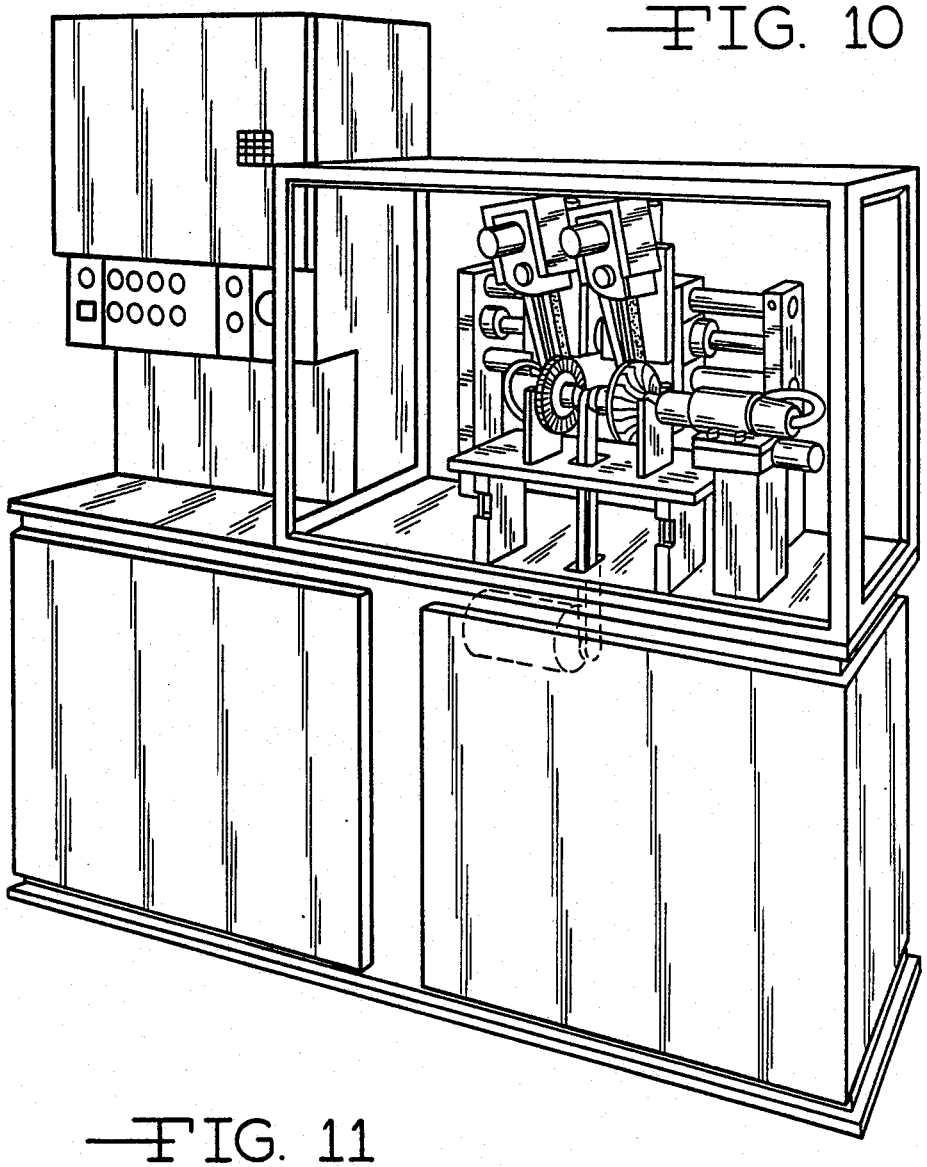
FIG. 10 shows a perspective view of an alternative embodiment of the present invention having a dual grinder material removal head.
Figure 11:
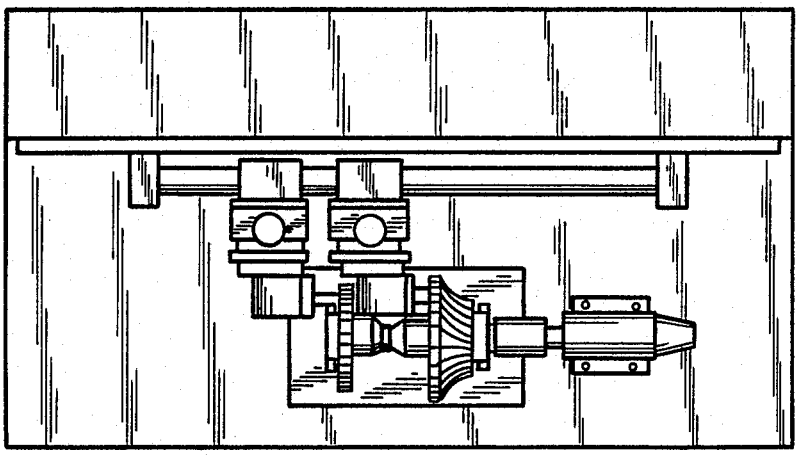
FIG. 11 shows a top view of FIG. 10.

Referring now to FIGS. 6 and 7, another embodiment of the present invention is shown. This second embodiment includes a positioning servo driven slide mechanism similar to the mechanism of the first embodiment. A drive screw 58 is fixed to the base member 10 adjacent the support stand 12 and workpiece mount 14. The drive screw 58 is operated by a servo drive 60 which receives its signal from the controller 16. A slide mechanism 62 is mounted on the base member 10 on opposed parallel sides of the drive screw 58. A primary mounting plate 64 is positioned on the slide mechanism 62 and operates to move on the slide mechanism 62 by the drive screw 58 and positioning drive 60. An encoder 66 is attached to the positioning drive 60 and keeps track of the mounting plate 64 as it travels along the slide mechanism 62. A mounting bar 68 is fixed to the mounting plate 64 and to the mounting bar 68 two flat springs are attached. At the free end of the flat springs 70, a support bar 74 is fixed on which the material removal head 72 is mounted. A sensor 76 is also fixed to the mounting bar 68 and is in communication with the support bar 74 on which the material removal head 72 is positioned. The sensor 76 is designed to detect any spring deflection when the material removal head 72 touches the edge of the workpiece. Any sensor type may be employed to sense the edge of the workpiece. One embodiment of the present invention envisions a spring and strain gauge combination to comprise a load cell.

During the correction operation, the balancer finds the edge of the part by touch. The sensor 76 senses when the material removal head 72 touches the workpiece. The material removal head 72 is then removed from contact a specified distance, started, and fed the calculated depth of material removal. The workpiece is then re-indexed and the process is repeated until tolerance is reached.

This second embodiment of the present invention is particularly applicable to provide a representative balancing correction for a specified workpiece being manufactured in an automatic production setting. The material removal head 72, in this instance a grinding belt, cuts a flat facet on the edge of the workpiece and if the workpiece is angular, the volume of the correction is difficult to calculate. The controller 16 is used to sum the slices and generate a table of material removal versus depth of cut for the particular workpiece. The controller 16 is programmed to run a polynomial regression calculation on the data to fit the correction curve wit a same percentage of tolerance. To provide this correction, the periphery of the workpiece is segmented into ten possible correction locations. A full depth correction handles about four tolerances. If the unbalance is less than four or five tolerances, the workpiece is corrected using two segments closest to the unbalance angle. If the correction required is larger than that value, the correction on the specified segment is reduced and the resulting correction is made by spreading the correction to adjacent segments. An alternative embodiment of this correction method is to slowly rotate the part during the grinding or milling operation to equally spread the material removal correction over more than one segment.

The locations and depth of all corrections are stored in memory by the controller 16 and the subsequent corrections are made to avoid those previous locations. The controller 16 will calculate additional corrections depending on the angular location of any residual unbalance. This process is repeated until the part is balanced within tolerance or the part is rejected.

The present invention envisions a wide variety programming of the controller 16. The controller 16 can be programmed to create its own workpiece correction profile. The controller 16 can be programmed to automatically adjust its preprogrammed figures to use information and data accumulated from past balancing operations to create a correction profile data table for use in accurately correcting other distinct workpiece configurations. Finally, the programming gives the controller 16 the adjustments necessary to facilitate force/time, unit/time, time only, area/time and speed/time relationships in reference to material removal.

The preferred embodiments, as described above, are intended to be exemplary in nature and by no means limit the scope of modification possible and apparent to those skilled in the art without materially departing from the intent and spirit of this invention.

We claim:

1. A process for determining the amount and angle of workpiece unbalance and applying a corrective removal application comprising the steps of:
   positioning a workpiece on a support;
   rotating such workpiece to determing the amount and angle of unbalance in the workpiece;
   stopping the rotation of the workpiece and orienting the workpiece relative to a material removal device;
   calculating a material removal rate for the workpiece, such calculation being based upon a data base having correction information relating to specific correction parameters;
   positioning said material removal device into contact with the workpiece;
   activating such material removal device to eliminate workpiece material according to said calculated material removal rate.

2. The process of claim 1 wherein said process is performed without operator assistance.

3. The process of claim 1 wherein such data base information is compiled as a result of previous workpiece correction histories.

4. The process of claim 3 wherein correction information from each workpiece correction is supplied to such data base in an ongoing operational basis whereby such data base correction information is continually refined by such new correction information.

5. The process of claim 1 wherein one of said parameters is based upon geometric workpiece profile.

6. The process of claim 1 wherein one of said parameters is based upon workpiece radius.

7. The process of claim 1 wherein one of said parameters is based upon the type of material removal device in use.

8. The process of claim 1 wherein one of said parameters is based upon force/time relationships of previous material removals.

9. The process of claim 1 wherein one of said parameters is based upon area/time relationships of previous removals.

10. The process of claim 1 wherein one of said parameters is based upon material removal device speed/time relationshps of previous removals.

11. The process of claim 1 wherein one of said parameters is workpiece material.

12. An improved balancing machine comprising, in combination:
   a base member;
   support means for receiving a workpiece positioned on said base member;
   drive means for rotating such workpiece;
   sensor means for determining the amount of unbalance and the angle of such unbalance of said workpiece;
   encoding means to stop such rotation and precisely position such workpiece relative to a material removal means, said material removal means being adjustable to accomodate distinct workpiece shapes and provide material removal at a variety of locations on such workpieces;
   means for activating said material removal means to remove a preestimated amount of material from such workpiece, said activating means including a positioning means to place said material removal means in communication with such workpiece and a second sensor means for determining such communication; and,
   programmable control means for regulating the operation of said drive means, encoder means, and material removal means.

13. A process for determining the amount and angle of workpiece unbalance and applying a corrective material removal application comprising the steps of:
   positioning a workpiece on a support;
   rotating such workpiece to determine the amount and angle of unbalance in the workpiece;
   stopping the rotation of the workpiece and orienting the workpiece relative to a material removal device;
   calculating a material removal rate for the workpiece;
   positioning such material removal device into contact with the workpiece;
   activating such material removal device to remove workpiece material according to said calculated material removal rate.

14. The process of claim 13, further including the step of rotating the workpiece again after removal of a preselected amount of workpiece material to determine if the workpiece is balanced within tolerance.

15. The process of claim 13, wherein said preselected amounts of workpiece material to be removed is calculated and programmed within a predetermined percentage of correction accuracy and further including the steps of:
   re-rotating the corrected workpiece to determine the amount and angle of remaining unbalance;
   stopping said re-rotation and re-orienting the workpiece relative to the material removal device;
   calculating the amount and rate of material removal necessary to balance the workpiece into tolerance, said calculation being performed as a function of the change in unbalance and the original removal rate;
   re-positioning the material removal device into contact with the workpiece;
   re-activating the material removal device to eliminate a preselected amount of the workpiece material.

16. The process of claim 15, further including the step of again rotating the workpiece to determine if the workpiece is balanced within tolerance.

17. The process of claim 13, wherein said process is performed repeatedly for a series of workpiece and said predetermined material removal rate is averaged with the previous removal rates to more accurately predetermine the removal rate of said first activation.

18. The process of claim 13, wherein such workpiece is slowly rotated during said activation of such material removal device to remove a preselected amount of workpiece material.

19. A process for determining the amoun and angle of workpiece unbalance and applying a corrective material removal application comprising the steps of:
   positioning a workpiece on a support;
   rotating such workpiece to determine the amount and angle of unbalance in the workpiece;
   providing information to a controller relating workpiece geometry and parameters;

calculating a material removal rate based upon said geometry and parameter information;

calculating a material removal area on such workpiece based upon said geometry and parameter information;

controlling the positioning of a material removal device with respect to the workpiece, such controlling being based upon said geometry and parameter information;

activating a material removal device to eliminate workpiece material.

20. An improved balancing machine comprising, in combination:

a base member;

support means for receiving a workpiece positioned on said base member;

drive means for rotating such workpiece;

sensor means for determining the amount of unbalance and the angle of such unbalance of such workpiece;

encoding means to stop such rotation and precisely position such workpiece relative to a material removal means;

means for activating said material removal means to remove a preestimated amount of material from such workpiece, said activating means including a positioning means to place said material removal means in communication with such workpiece, said positioning means including a second sensor means for determining the contact between said material removal means and such workpiece, maintaining the contact between said material removal means and such workpiece and for determining the amount of force applied by said material removal means to such workpiece; and, programmable control means for regulating the operation of said drive means, encoding means, and material removal means.

21. The balancing machine of claim 20, wherein said second sensor and positioning means further operates to modulate a given force between said material removal means and such workpiece during operation of said material removal device.

22. An improved balancing machine comprising, in combination:

a base member;

support means for receiving a workpiece positioned on said base member;

drive means for rotating such workpiece;

sensor means for determining the amount of unbalance and the angle of such unbalance of such workpiece;

encoding means to stop such rotation and precisely position such workpiece relative to a material removal means;

means for activating said material removal to remove a preestimated amount of material from such workpiece, said activating means including a positioning means to place said material removal means in communication with such workpiece; and, programmable control means for regulating the operation of said drive means, encoding means and material removal means and for calculating the material removal rate of said material removal means.

23. An improved balancing machine comprising, in combination:

a base member;

support means for receiving a workpiece positioned on said base member;

drive means for rotating such workpiece;

sensor means for determining the amount of unbalance and the angle of such unbalance of such workpiece;

encoding means to stop such rotation and precisely position such workpiece relative to a material removal means wherein said material removal means includes more than one distinct grinding head and further includes a distinct sensing apparatus for each distinct grinding head, each of said distinct sensing apparatuses operating to determine contact between each of said grinding heads and such workpiece and for determining the amount of force applied by each of said grinding heads to such workpiece;

means for activating said material removal means to remove a preestimated amount of material from such workpiece, said activating means including a positioning means to place said material removal means in communication with such workpiece; and, programmable control means for regulating the operation of said drive means, encoding means and material removal means.

24. An improved balancing machine comprising, in combination:

a base member;

support means for receiving a workpiece positioned on said base member;

drive means for rotating such workpiece;

sensor means for determining the amount of unbalance and the angle of such unbalance of such workpiece;

encoding means to stop such rotation and precisely position such workpiece relative to a material removal means;

means for activating said material removal means to remove a preestimated amount of material from such workpiece; and, programmable control means for regulating the operation of said drive means, encoding means and material removal means and for calculating a material removal rate for a given workpiece using information retained in a data base, such data base being compiled as a result of previous material removal operations on like workpieces.

* * * * *